US006738586B2

(12) United States Patent
Kubota et al.

(10) Patent No.: US 6,738,586 B2
(45) Date of Patent: May 18, 2004

(54) PRINT CONTROL METHOD OF ELECTROPHOTOGRAPH AND IMAGE FORMATION APPARATUS WITH POTENTIAL SENSOR USING THE METHOD

(75) Inventors: Keisuke Kubota, Ibaraki (JP); Teruaki Mitsuya, Ibaraki (JP); Hiroyuki Mabuchi, Ibaraki (JP); Masayoshi Ishii, Ibaraki (JP); Shinichi Akatsu, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/067,766

(22) Filed: Feb. 8, 2002

(65) Prior Publication Data

US 2002/0127026 A1 Sep. 12, 2002

(30) Foreign Application Priority Data

Mar. 9, 2001 (JP) ..... P2001-066086

(51) Int. Cl.[7] ..... G03G 15/00; G03G 10/08

(52) U.S. Cl. ..... 399/48; 399/26; 399/53; 399/56

(58) Field of Search ..... 399/48, 53, 56, 399/160, 26

(56) References Cited

U.S. PATENT DOCUMENTS 5,160,967 A * 11/1992 Tonegawa
5,805,956 A * 9/1998 Kawai et al. ..... 399/48
6,529,693 B2 * 3/2003 Tomizawa et al.

FOREIGN PATENT DOCUMENTS

JP 5-341608 * 12/1993
JP 7-333949 * 12/1995
JP 10-246994 * 9/1998

* cited by examiner

*Primary Examiner*—Susan S.Y. Lee
(74) *Attorney, Agent, or Firm*—McGinn & Gibb, PLLC

(57) ABSTRACT

A print control method of an electrophotograph in an image formation apparatus including at least a photoconductor, a charger, a light exposure unit, and a developing device for forming a background area and an image area on the photoconductor using the charger and the light exposure unit and detecting a potential of the image area after transfer and controlling a developing electric field, thereby printing an electrophotograph, includes lowering the percentage of toner covering the image area on the photoconductor when the potential is detected.

17 Claims, 12 Drawing Sheets

| | | HUMIDITY | | |
|---|---|---|---|---|
| | | < 20%RH | < 65%RH | < 100%RH |
| CHARGE DENSITY | < 0.03μC/cm² | 40V | 60V | 80V |
| | < 0.04μC/cm² | 70V | 90V | 110V |
| | < 0.05μC/cm² | 100V | 120V | 140V |

PRINT CONTROL METHOD OF ELECTROPHOTOGRAPH AND IMAGE FORMATION APPARATUS WITH POTENTIAL SENSOR USING THE METHOD

BACKGROUND OF THE INVENTION

1. Field of the Invention

This invention relates to a print control method of electrophotography for rendering an image visible using coloring particles of toner, etc., of a printer, a facsimile, a copier, etc., and a recording apparatus using the method and in particular to a print control method in a print process consisting of charging, light exposure, developing, and transfer for forming a toner image on the surfaces of a photoconductor and record paper and an image formation apparatus using the method.

2. Description of the Related Art

As for the print control method of electrophotography, first a method in a related art will be discussed. An image formation apparatus using electrophotography includes a print process of rendering coloring particles visible on the surface of a record body as an image and a fixing process of fixing the coloring particle image rendered visible on the record body.

In the charging step, the full surface of the photoconductor is once charged and subsequently in the light exposure step, light is applied, thereby partially discharging. A potential contrast based on the charge area and the discharge area is formed on the surface of the photoconductor and is called an electrostatic latent image. In the developing step following the light exposure step, first the toner images of coloring particles are charged. As the toner charging method, a dual-component developing method using carrier beads or a mono component developing method of charging by friction with a toner member, etc., is available.

On the other hand, to render an electrostatic latent image visible, a method called bias developing is often used. In the bias developing, a bias voltage is applied to a developing roller for separating from the latent image potential formed on the surface of a photoconductor and the developer on the surface of the developing roller and moving to the surface of the photoconductor for forming an image. The above-mentioned charge potential or discharge potential may be used as the latent image potential. Generally, the method of using the charge potential as the latent image potential is called normal developing method and the method of using the discharge potential is called inverse developing method. The charge potential or discharge potential, whichever is unused as the latent image potential, is called background potential. The bias voltage of the developing roller is set midway between the charge potential and the discharge potential, and the difference between the bias voltage of the developing roller and the latent image potential is called developing potential difference. Likewise, the difference between the developing bias and the background potential is called background potential difference.

In the image formation apparatus of electrophotography, toner is jetted from the developing unit to the photoconductor surface in response to the latent image potential on the photoconductor for forming an image, and the image density changes with the toner amount for developing. It is generally known that the amount of toner jetted from the developing unit is proportional to the magnitude of the developing electric field, the electric field in the developing portion between the photoconductor and the developing unit. This developing electric field is noticeably observed in the edge part of a solid latent image and a line latent image. Thus, potential Vr2 called middle potential is provided between the developing bias and the latent image potential for reducing the toner deposition amounts on the edge part of the solid latent image and the line latent image. Formation of the electrostatic latent image and toner image on the photoconductor surface has been described.

Next, varying of the electrostatic latent image on the photoconductor surface with time will be discussed. When the photoconductor is degraded as the print amount grows, the charge area potential (charge potential) lowers and it becomes hard to charge. On the other hand, the discharge area potential (discharge potential) rises and it becomes hard to discharge. Lowering the discharge performance is remarkable if an intermediate potential area with incomplete discharge with an insufficient exposure light amount given is provided. This intermediate potential area mentioned here is often used for the purpose of thickness prevention, etc., in an image area where toner is too much developed with the strong peripheral effect of the electric field such as thin lines and dots. The described potential change acts in the direction of lowering the developing electric field to lessen the developing potential difference. On the other hand, in addition to the characteristic, the thickness of the photosensitive layer of the photoconductor decreases due to wear as the print amount grows. The decrease in the film thickness acts in the direction of increasing the developing electric field. Which of the two mutually contradictory tendencies is superior varies from one printing apparatus to another.

In any way, to keep the image quality constant over time, control needs to be performed for maintaining stable the potential of the latent image formed on the photoconductor and suppressing growing of the developing electric field because of decrease in the film thickness of the photoconductor. Generally, it is known that a potential sensor is used as means for detecting the potential on the photoconductor surface to perform such potential and electric field stabilizing control. For example, a method described in JP-A-11-15214 can be named as an art in a related art concerning such a surface potential control method of a photoconductor.

However, a potential sensor is placed between a light exposure unit and a developing device in the related art and thus it is necessary to provide an additional space for placing the potential sensor between the light exposure unit and the developing device. However, the distance between the light exposure point and the developing point is an area requiring strict design because of the light attenuation characteristic that the photoconductor has, and placing the potential sensor at such a position results in reception of every restriction. However, if the potential sensor is placed downstream in the photoconductor rotation direction from the developing device, it is impossible to measure the precise potential because of toner developing, namely, another problem arises.

In the described related art, the developing potential and the background potential on the photoconductor surface are changed so as to make the developing electric field constant and thus the image quality becomes stable in thin lines and dots with the range covered by the peripheral effect of the electric field as the main image areas, for example. However, in a wide solid area (solid image) where parallel and peripheral electric fields mix, etc., if stability of the image quality because of the peripheral effect of the electric field of the periphery is provided, a problem of lowering the density arises in the portion developed by the parallel electric field of the center.

SUMMARY OF THE INVENTION

It is an object of the invention to provide a print control method of an electrophotograph and an image formation apparatus of an electrophotograph wherein a potential sensor is placed in a post-transfer area where the packing density is comparatively sparse and at the place, the potential on the photoconductor drum surface at the developing point can be detected.

It is another object of the invention to provide a film thickness detection method of a photoconductor drum, fitted for an image formation apparatus wherein a potential sensor is placed in a post-transfer area.

It is another object of the invention to provide a print control method for keeping the image quality stable as time goes by if the photoconductor drum film thickness is changed in an image formation apparatus of an electrophotograph wherein a potential sensor is placed in a post-transfer area.

It is a further object of the invention to provide an image formation apparatus of an electrophotograph for printing a good image stably as time goes by wherein a potential sensor is placed in a post-transfer area.

One feature of the invention is characterized by a print control method of an electrophotograph in an image formation apparatus comprising at least a photoconductor, a charger, a light exposure unit, and a developing device for forming a background area and an image area on the photoconductor using the charger and the light exposure unit and detecting the potential of the image area after transfer and controlling the developing electric field, thereby printing an electrophotograph, wherein when the potential is detected, the toner covering percentage of the image area on the photoconductor is lowered.

Another feature of the invention is characterized by the fact that when the potential is detected, carrier fly suppression control is performed.

Another feature of the invention is characterized by a print control method in an image formation apparatus of an electrophotograph comprising at least a photoconductor, a charger, a light exposure unit, and a developing device for forming a background area and an image area on the photoconductor using the charger and the light exposure unit and detecting the potential of the image area after transfer, wherein a middle potential is set between a latent image potential and a developing bias, and wherein the film thickness of the photoconductor is detected and feedback control of the middle potential is performed so that the developing electric field becomes constant based on the detected film thickness.

According to the invention, a potential sensor is placed in a post-transfer area and at the position, the potential on the photoconductor drum surface at the developing point is detected. When the potential on the photoconductor drum surface is detected, the developing bias is avoided at the optimum timing and the potential is detected at the position after transfer. The correction potential amount grasped based on the in-machine humidity and the photoconductor drum film thickness previously measured is added to the detected potential and it is made possible to detect the potential on the photoconductor drum surface which is the same as the developing device position.

Feedback control is applied based on the corrected potential detection value, whereby the potential of the latent image formed on the photoconductor drum is kept stable as time goes by, the thickness of the photosensitive layer of the photoconductor drum is detected, the developing electric field is controlled based on the detected information, and change over time, caused by the thickness of the photosensitive layer is also eliminated.

DETAILED DESCRIPTION OF THE PREFERRED EMBODIMENTS

Referring now to the accompanying drawings, there are shown preferred embodiments of image formation apparatus of the invention.

<First Embodiment>

First, a first embodiment of the invention will be discussed with reference to FIGS. 1 to 12.

Figure 1:
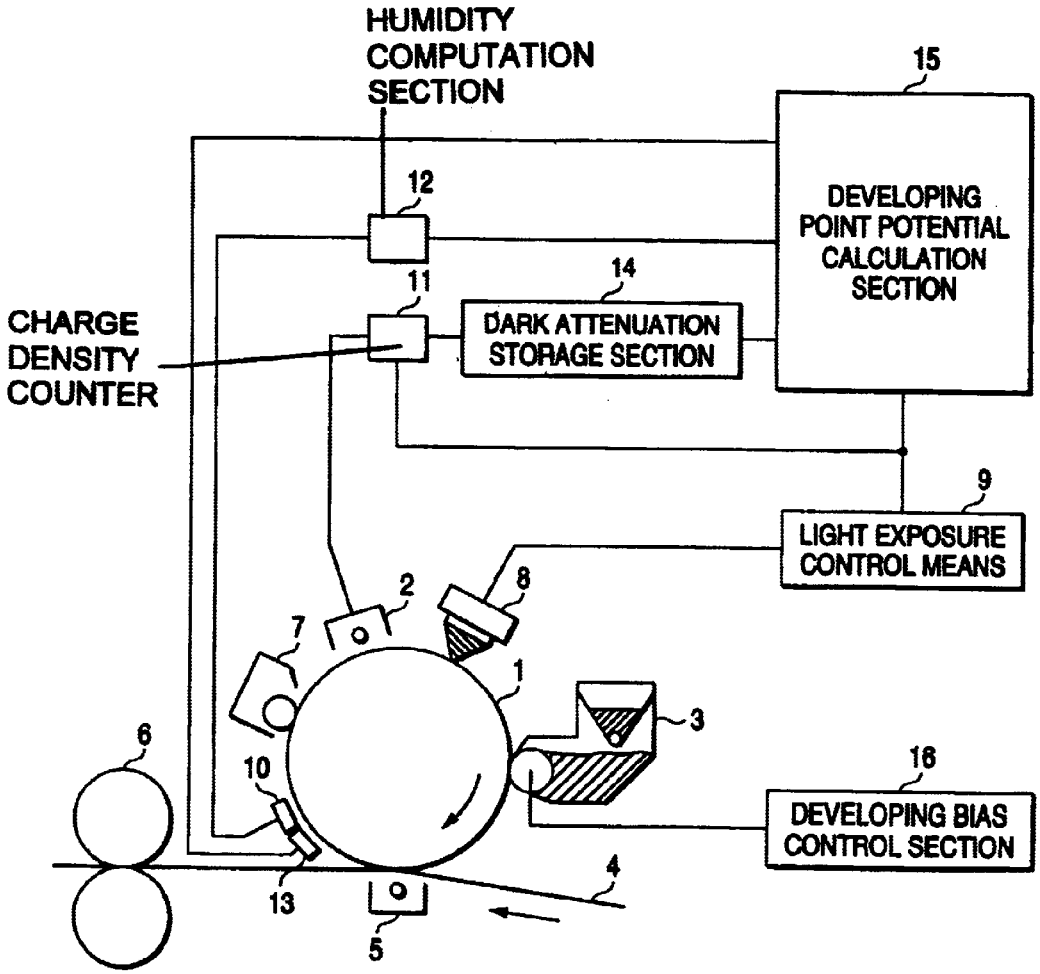
FIG. 1 is a drawing to schematically represent the cross section of an image formation apparatus according to a first embodiment of the invention.

FIG. 1 is a drawing to schematically represent the cross section of an image formation apparatus of the first embodiment. Numeral 1 denotes a photoconductor drum, numeral 2 denotes a charger, numeral 3 denotes a developing device, numeral 4 denotes record paper, numeral 5 denotes a transfer device, numeral 6 denotes a fuser, numeral 7 denotes a cleaner, numeral 8 denotes a light exposure unit, and numeral 9 denotes light exposure control means. Numeral 10 denotes a potential sensor for detecting the potential of an image area after transfer. Numeral 11 denotes a charge density counter, numeral 12 denotes a humidity computation section, and numeral 13 denotes a temperature and humidity sensor. Numeral 14 denotes a dark attenuation storage section for storing dark attenuation potential amount $\beta$. Numeral 15 denotes a developing point potential calculation section for extracting the dark attenuation potential amount $\beta$ from the dark attenuation storage section 14 and adding the potential amount to the potential detected by the potential sensor 10, thereby calculating the potential on the photoconductor surface at the developing position and reproducing the potential for controlling the light exposure unit 8 through the light exposure control means 9. Numeral 16 denotes a developing bias control section for performing developing bias control to detect the potential after transfer.

In the image formation apparatus of the embodiment in FIG. 1, on the surface of the photoconductor drum 1 charged uniformly by the charger 2, an electrostatic latent image is formed by the light exposure unit 8 made up of a semiconductor laser whose light emission is controlled by the light exposure control means 9 implemented as a laser driver, etc., and an optical system. After this, toner is developed by the developing device 3. The toner developed on the surface of the photoconductor drum 1 is transferred to the record paper 4 by the transfer device 5. After this, the transferred toner image is heated and fused by the fuser 6 and is fixed on the record paper 4. The toner untransferred and left on the surface of the photoconductor drum 1 is collected by the cleaner 7 and the process is now complete.

In the image formation apparatus of the embodiment, the potential on the surface of the photoconductor drum 1 is detected by the potential sensor 10 and the dark attenuation potential amount $\beta$ is added to potential detection value $V_{r2}'$ and the light exposure amount of the light exposure unit 8 can be adjusted by the light exposure control means 9 based on corrected detection value—($|V_{r2}'|+\beta$). The charge density on the surface of the photoconductor drum 1 can be counted by the charge density counter 11 and the light exposure amount of the light exposure unit 8 can be adjusted by the light exposure control means 9 based on the count.

Next, a potential detection method at the post-transfer position will be discussed by taking detection of middle potential $V_{r2}$ between latent image potential $V_{r1}$ and developing bias $V_b$ as an example.

Figure 3:
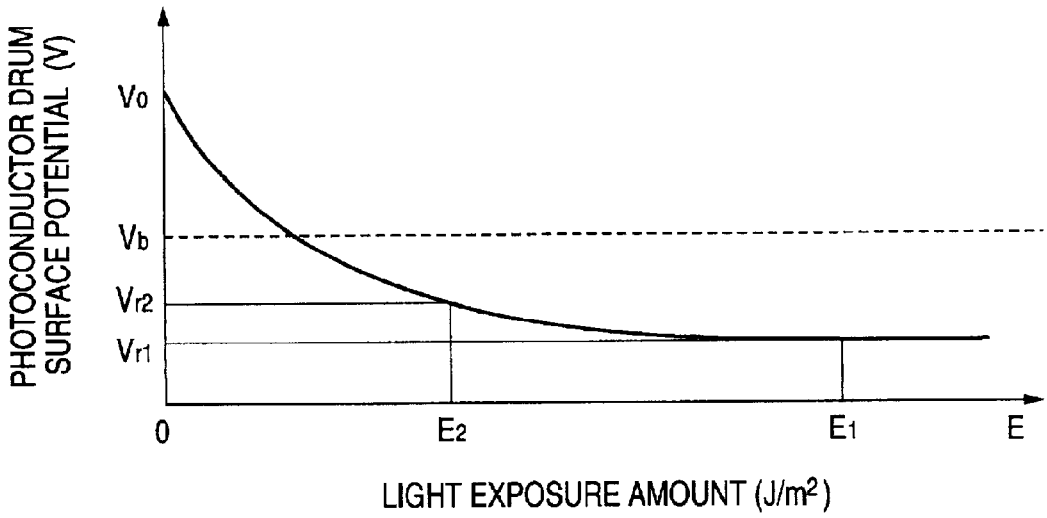
FIG. 3 is a drawing to show the light response characteristic of a photoconductor drum in the first embodiment of the invention.

First, FIG. 3 is a drawing to show the light response characteristic of the photoconductor drum 1. Horizontal axis E indicates the light exposure amount in terms of light energy input to the photoconductor drum 1. Vertical axis indicates the potential of the photoconductor drum 1 at a given time after light exposure. The time after light exposure is set equal to the time required from the light exposure to developing of the image formation apparatus. $V_0$ on the vertical axis indicates the background potential in developing. In the image formation apparatus, two steps of light exposure amounts $E_1$ and $E_2$ are provided by the light exposure control means 9. $V_{r1}$ on the vertical axis means the potential of the photoconductor drum 1 corresponding to the light exposure amount $E_1$ and $V_{r2}$ means the potential of the photoconductor drum 1 corresponding to the light exposure amount $E_2$. $V_b$ means the bias potential of the developing device and $V_b-V_{r1}$ and $V_b-V_{r2}$ are developing potential differences. The light exposure control means 9 controls so as to use $V_b-V_{r1}$ as the developing potential for a wide solid area (solid image) and use $V_b-V_{r2}$ as the developing potential for line images and dots where the electric field peripheral effect acts strongly.

Figure 2:
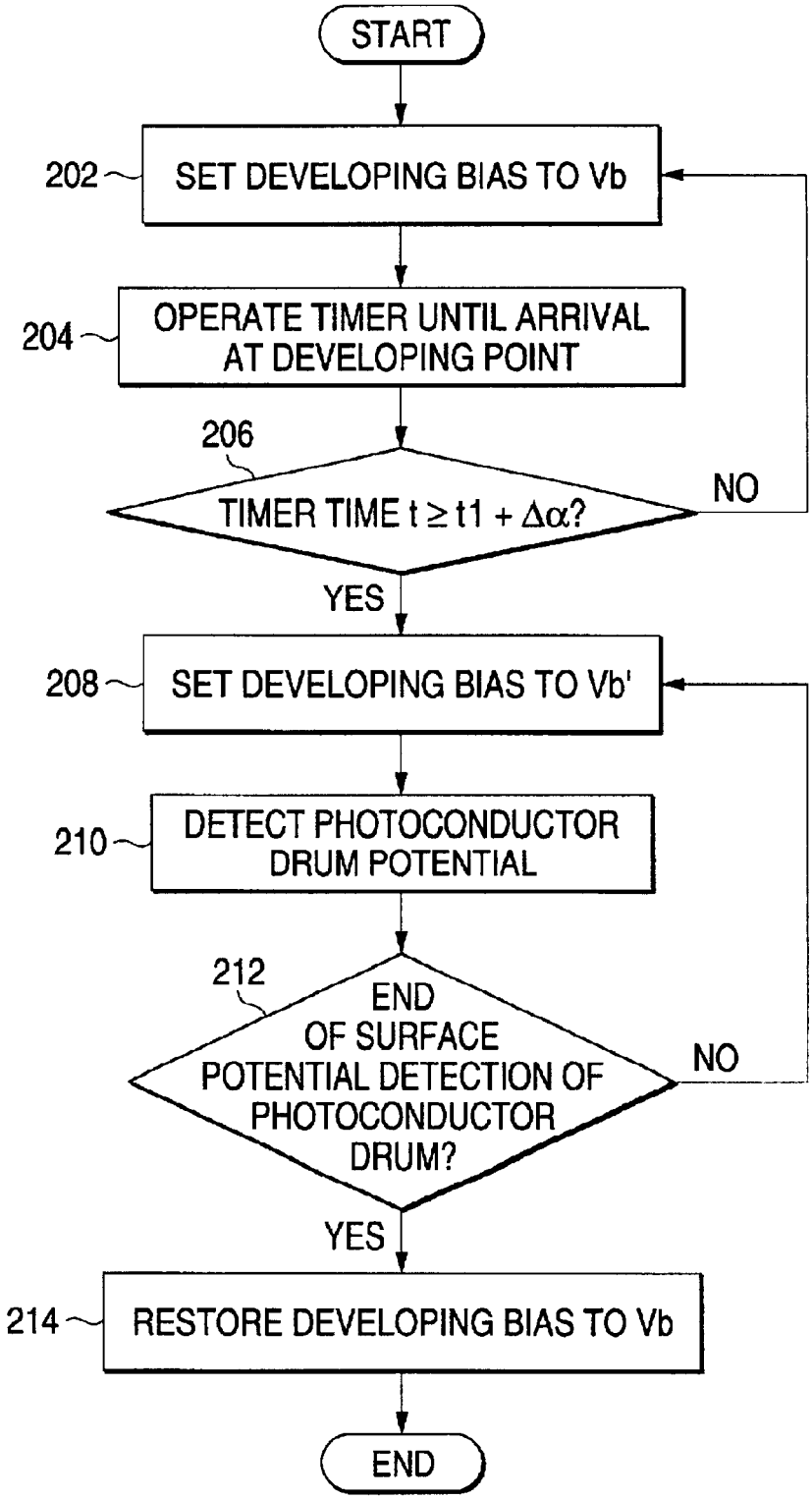
FIG. 2 is a flowchart of developing bias control to detect a potential after transfer in the first embodiment of the invention.

Next, FIG. 2 is a flowchart of developing bias control of the light exposure control means 9 to detect the potential after transfer. First, the developing bias is set to $V_b$ (S202) and further arrival at the developing point is determined (S204). When the time after arriving at the developing point (=t1+$\Delta\alpha$) is reached (S206), the developing bias is set to developing bias after avoidance, $V_b'$, (S208) and photoconductor potential is detected (S210). After this, the developing bias is restored to $V_b$ (S212 and S214).

The latent image potential $V_{r1}$ of the middle potential $V_{r2}$ formed on the photoconductor drum 1 by the light exposure unit 8 develops toner on the photoconductor drum 1 according to the developing bias $V_b$ and consequently attempts to become a potential to the same extent as the developing bias $V_b$. In short, the potential on the surface of the photoconductor drum 1 is determined matching the level of the developing bias $V_b$. Therefore, in the developing device 3 in the embodiment, to detect the middle potential $V_{r2}$ (S210), the developing bias is avoided in the direction of not developing toner on the surface of the photoconductor drum 1 (S208).

Figure 4:
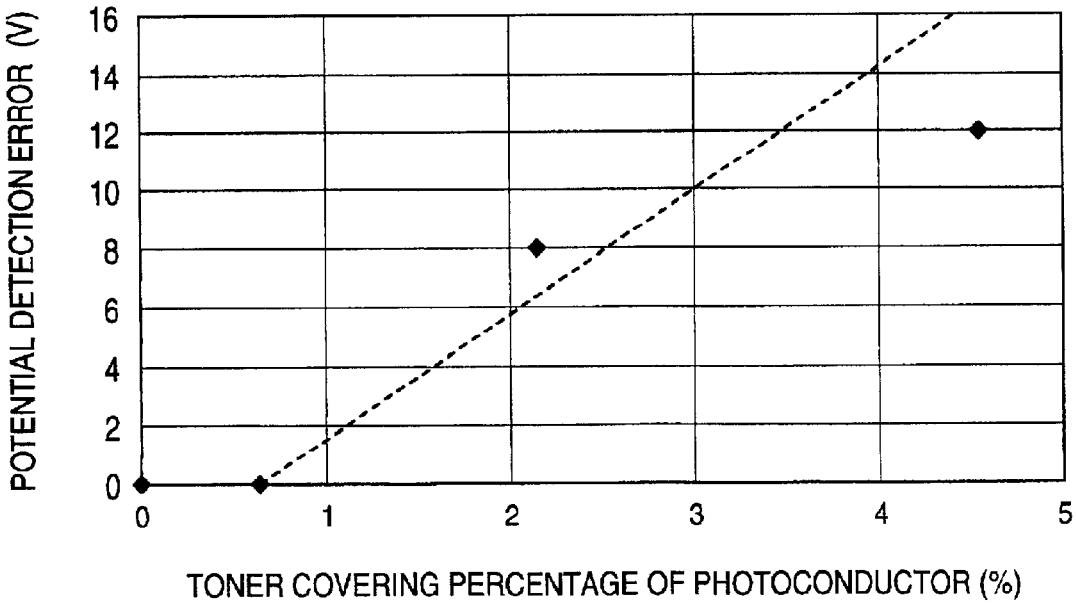
FIG. 4 is a drawing to show the toner covering percentage and potential sensor detection error in the first embodiment of the invention.

Next, FIG. 4 plots the toner covering percentage of the photoconductor drum surface on the horizontal axis and detection error of the potential sensor on the vertical axis. In the embodiment, the developing bias is set so that the toner covering percentage of the photoconductor drum surface becomes 0.7% or less as a condition under which the detection value of the potential sensor 10 is not affected by toner developing.

Figure 5:
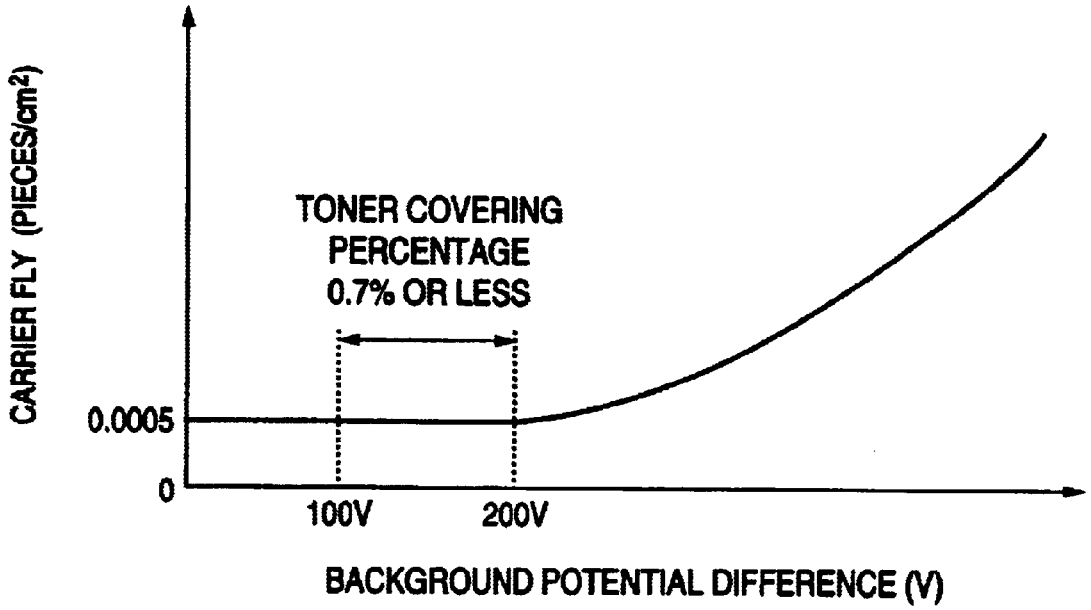
FIG. 5 is a drawing to show the relationship between the background potential difference and carrier fly in the first embodiment of the invention.

FIG. 5 is a drawing to represent the number of carrier flies occurring accompanying developing bias avoidance. The horizontal axis indicates the background potential difference and the horizontal axis indicates the number of carrier flies at the time. When the dual-component developing method is used as the developing method, if the developing bias is avoided when the middle potential $V_{r2}$ is detected, if the post-avoided developing bias $V_b'$ and the background potential are large, the carrier charged at the opposite polarity to that of the toner in the developing part is flied by the electric field in the photoconductor drum direction formed by the developing bias $V_b'$ and the background potential.

In the recording apparatus in the embodiment, the post-avoided developing bias $V_b'$ is set so that the background potential difference satisfying the conditions that carrier fly does not occur and that the toner covering percentage of the photoconductor drum is 0.7% or less becomes 100 V and 200 V.

Figure 6:
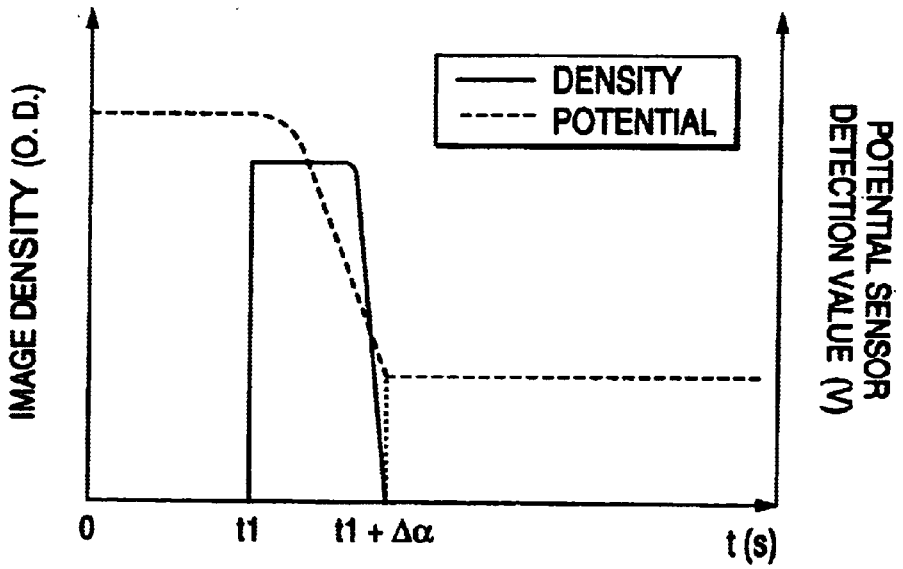
FIG. 6 is a drawing to show a toner developing area on the photoconductor drum when carrier fly does not occur in the first embodiment of the invention.

FIG. 6 shows detection value when developing bias avoidance is actually conducted by the light exposure control means 9 and potential is detected after transfer (=t1+Δα). The horizontal axis indicates the time and the vertical axis indicates the image density and the detection value of the potential sensor at the time.

Figure 7:
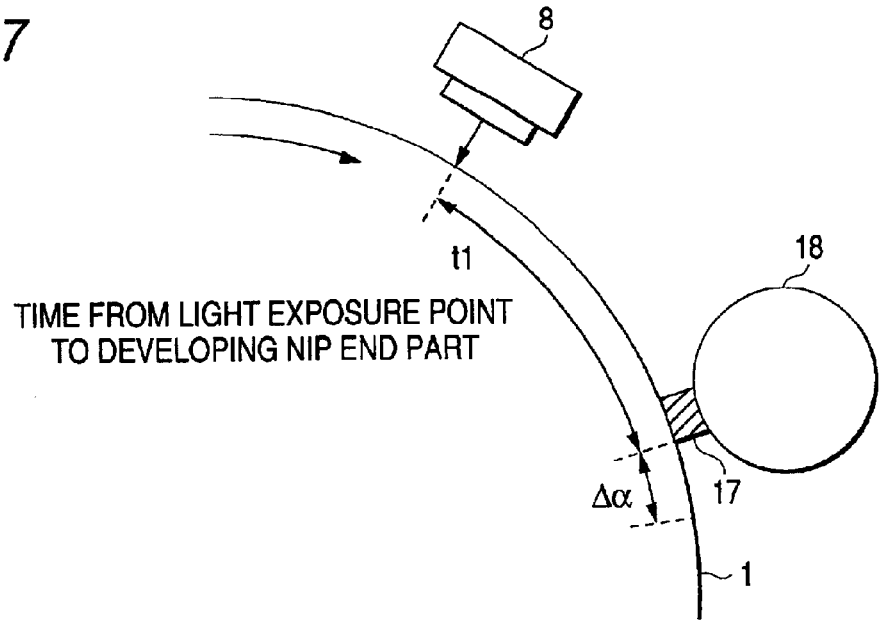
FIG. 7 is a schematic drawing to show the timing of developing bias avoidance of a developing device having one developing roll in the first embodiment of the invention.

FIG. 7 is a drawing to schematically show the timing avoiding the developing bias for the developing device 3 having one developing roll 18. To prevent carrier fly from occurring, it becomes necessary to avoid the developing bias when the potential to be detected $V_{r2}$ passes through a developing nip part 17. The time from the light exposure point corresponding to the light exposure unit 7 to the potential passing through the developing nip part 17, t1, is previously measured. When the potential is detected, if the developing bias $V_b$ is avoided to $V_b'$ in t1 after the light exposure point, the conditions that no carrier fly occurs and that a detection error of the potential sensor 10 caused by toner developing does not occur are satisfied. For the potential detection timing at this time, toner as wide as the width in the circumferential direction of the photoconductor drum corresponding to the total time Δα of the falling time of the internal power supply for supplying the developing bias and the time corresponding to the developing nip width is developed on the photoconductor drum and thus the time is delayed and the potential is detected.

Therefore, in the image formation apparatus of the embodiment, the developing bias avoidance level and timing are set as shown in FIG. 7, thereby making it possible to detect the potential by the potential sensor after transfer.

Further, in the image formation apparatus of the embodiment, to reproduce the potential at the position of the developing device 3, a method of adding a potential correction amount is used. The detection value of the potential sensor 10 described above contains the dark attenuation lowering component produced with the time passage after the photoconductor drum is exposed to light, and the potential at the developing time differs from the potential detection value after transfer. The dark attenuation characteristic of the photoconductor drum varies depending on the film thickness and humidity of the photoconductor drum.

Figure 8:
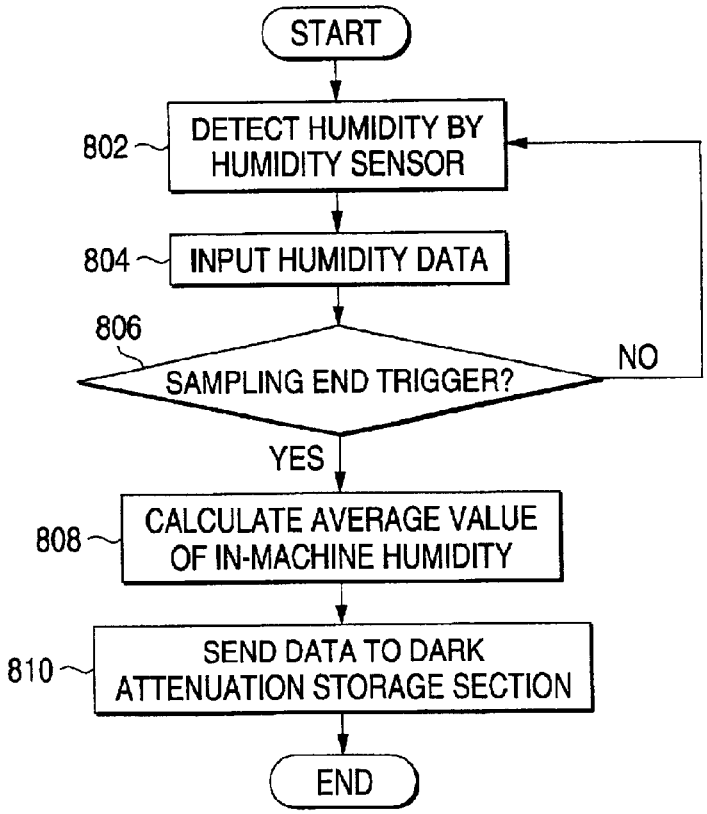
FIG. 8 is a flowchart of humidity detection in the first embodiment of the invention.

FIG. 8 is a flowchart of in-machine humidity detection processing of the light exposure control means 9 and the humidity computation section 12. The humidity in the machine is detected by the humidity sensor (S802 to S806) and an average value of the in-machine humidity is calculated (S808) and the data is sent to the dark attenuation storage section 14 (S810).

The light exposure control means 9 extracts the dark attenuation potential amount of the photoconductor drum from the dark attenuation storage section 14 based on the detection value and adds the dark attenuation potential amount to the detected potential, thereby calculating the potential on the photoconductor drum surface at the developing position and reproducing the potential.

Figure 9:
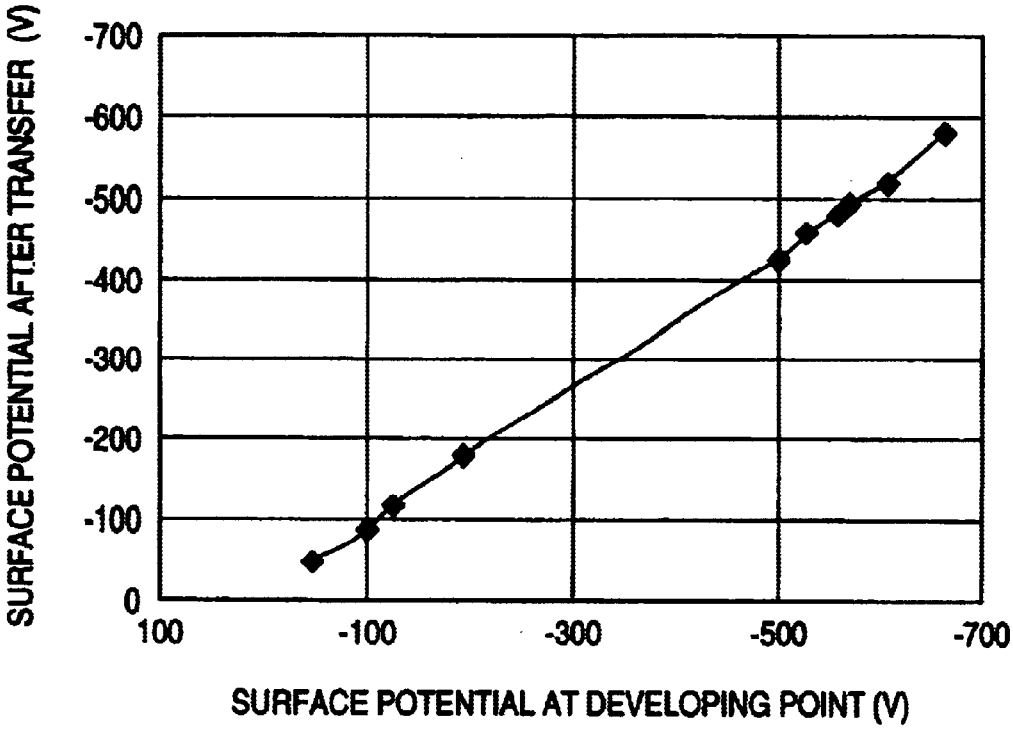
FIG. 9 shows surface potentials at the developing position and the position after transfer in the first embodiment of the invention.

FIG. 9 shows an example of detection values of the potential sensor 10 at the developing position and the transfer position. The photoconductor drum surface potentials at the developing point are plotted on the horizontal axis and the photoconductor drum surface potentials after transfer are plotted on the vertical axis. It is seen that the charge potential of the photoconductor drum lowers with the time to detection. This is the potential lowering component based on the dark attenuation characteristic of the photoconductor drum described above.

Figure 10:
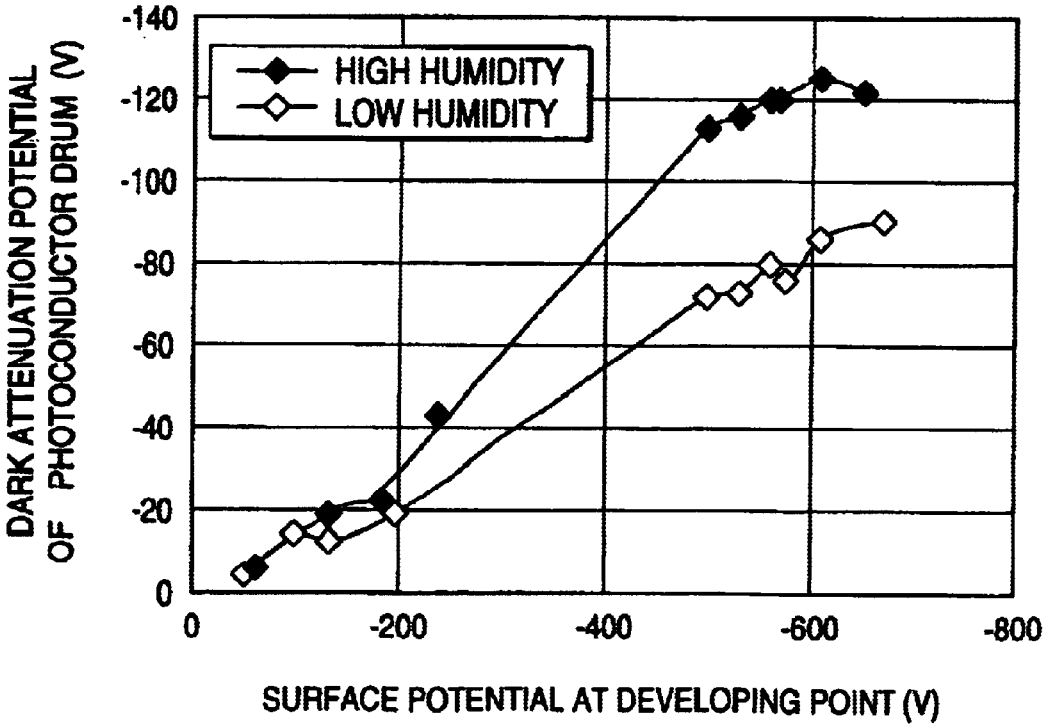
FIG. 10 is a drawing to show the dark attenuation characteristic of the photoconductor drum depending on the humidity in the first embodiment of the invention.

FIG. 10 shows the potential lowering result of dark attenuation of the photoconductor drum depending on the humidity. The lower the humidity of the photoconductor drum atmosphere, the less potential lowering caused by dark attenuation; the higher the humidity of the photoconductor drum atmosphere, the more potential lowering caused by dark attenuation.

Figures 11, 12:
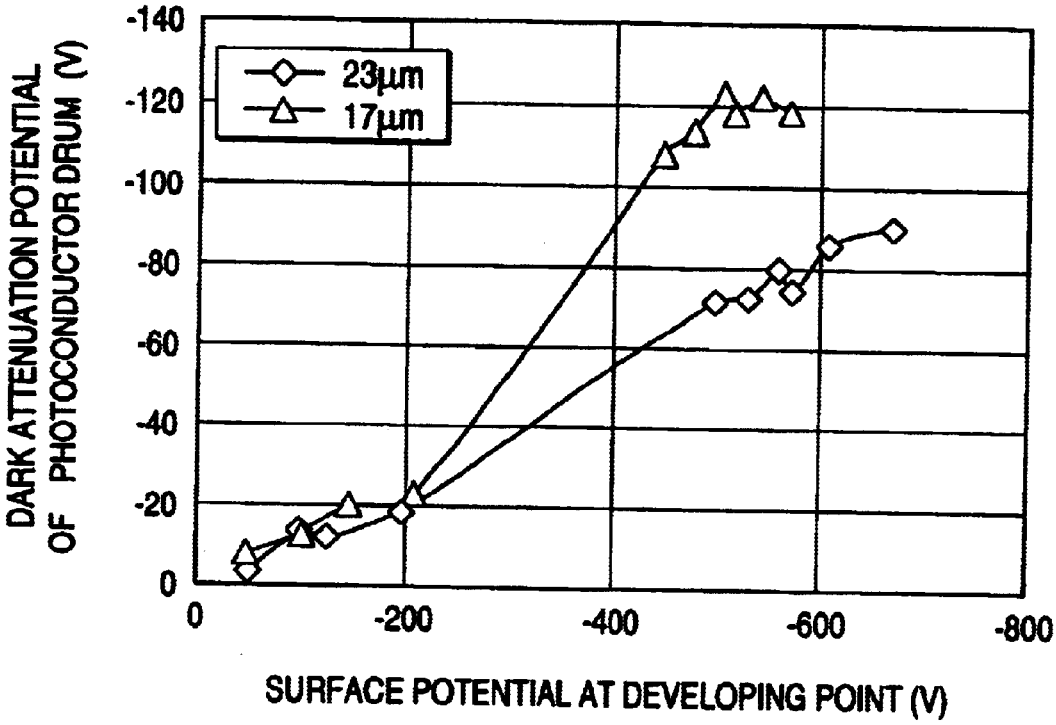
FIG. 11 is a drawing to show the dark attenuation characteristic of the photoconductor drum depending on the film thickness in the first embodiment of the invention.
FIG. 12 is a matrix table in a dark attenuation storage section in the first embodiment of the invention.

Further, FIG. 11 shows dark attenuation change caused by change in the film thickness of the photoconductor drum. As the film thickness of the photoconductor drum is decreased with an increase in the number of print sheets of paper, potential lowering caused by dark attenuation grows.

From the results in FIGS. 9 to 11, it is seen that the dark attenuation depends on the atmosphere and the film thickness of the photoconductor drum. Thus, the light exposure control means 9 previously measures the dark attenuation potential amount β. In the embodiment, a method of estimating the film thickness by calculating the charge density on the photoconductor drum surface by the charge density counter 11 as a parameter depending on the film thickness of the photoconductor drum is used. In the image formation apparatus of the embodiment, to detect the film thickness of the photoconductor drum, a method of estimating the film thickness by measuring the current flowing into the photoconductor drum by the charge density counter 11 is used.

In the invention, the dark attenuation potential amount β is previously grasped as a matrix table based on humidities and surface charge densities and the matrix table of the dark attenuation potential amount β is stored in the dark attenuation storage section 14.

FIG. 12 shows an example of the dark attenuation potential amount β recorded in the dark attenuation storage section 14 in the form of the matrix table of the humidities and the surface charge densities.

In the matrix table in FIG. 12, when the potential is detected, the humidity is detected by the humidity sensor 13 placed in the machine and further the film thickness of the photoconductor drum is detected by the charge density counter 11.

Figure 13:
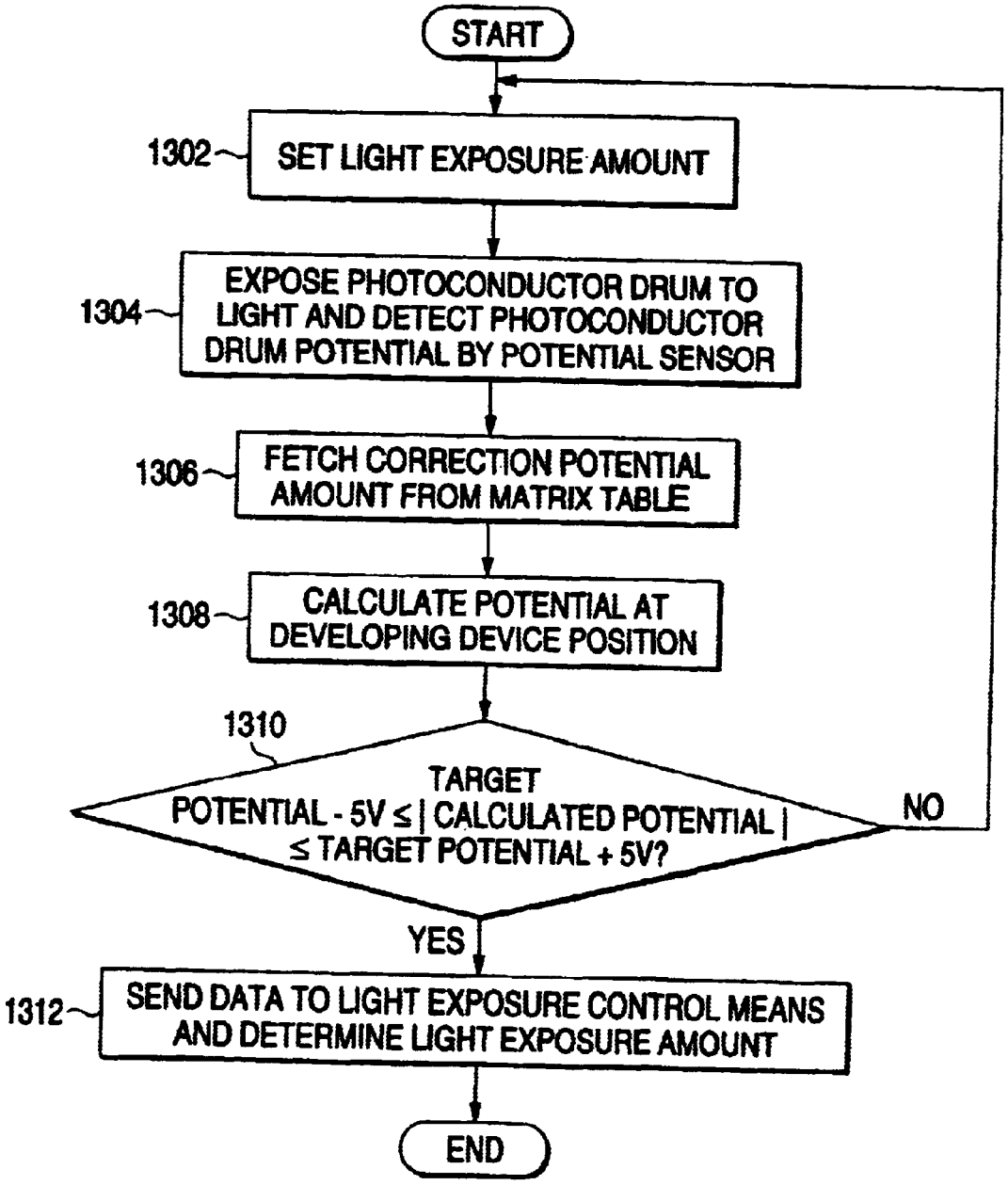
FIG. 13 is a flowchart of calculating the potential at the developing position in the first embodiment of the invention.

FIG. 13 is a flowchart of processing of calculating the potential on the photoconductor drum surface at the developing position by the light exposure control means 9. First, the light exposure amount is set (S1302) Next, the photoconductor drum is exposed to light and the potential on the photoconductor drum surface is detected by the potential sensor (S1304). The correction potential amount, namely, the dark attenuation potential amount β is fetched from the matrix table shown in FIG. 12 (S1306). Further, the potential at the developing device position is calculated (S1308) and if the calculated potential is in the range of the target potential ±5 V (S1310), data is sent to the light exposure control means 9 and the light exposure amount is determined (S1312). If the calculated potential is not in the range of the target potential ±5 V, the process is again executed starting at setting the light exposure amount.

Figure 14:
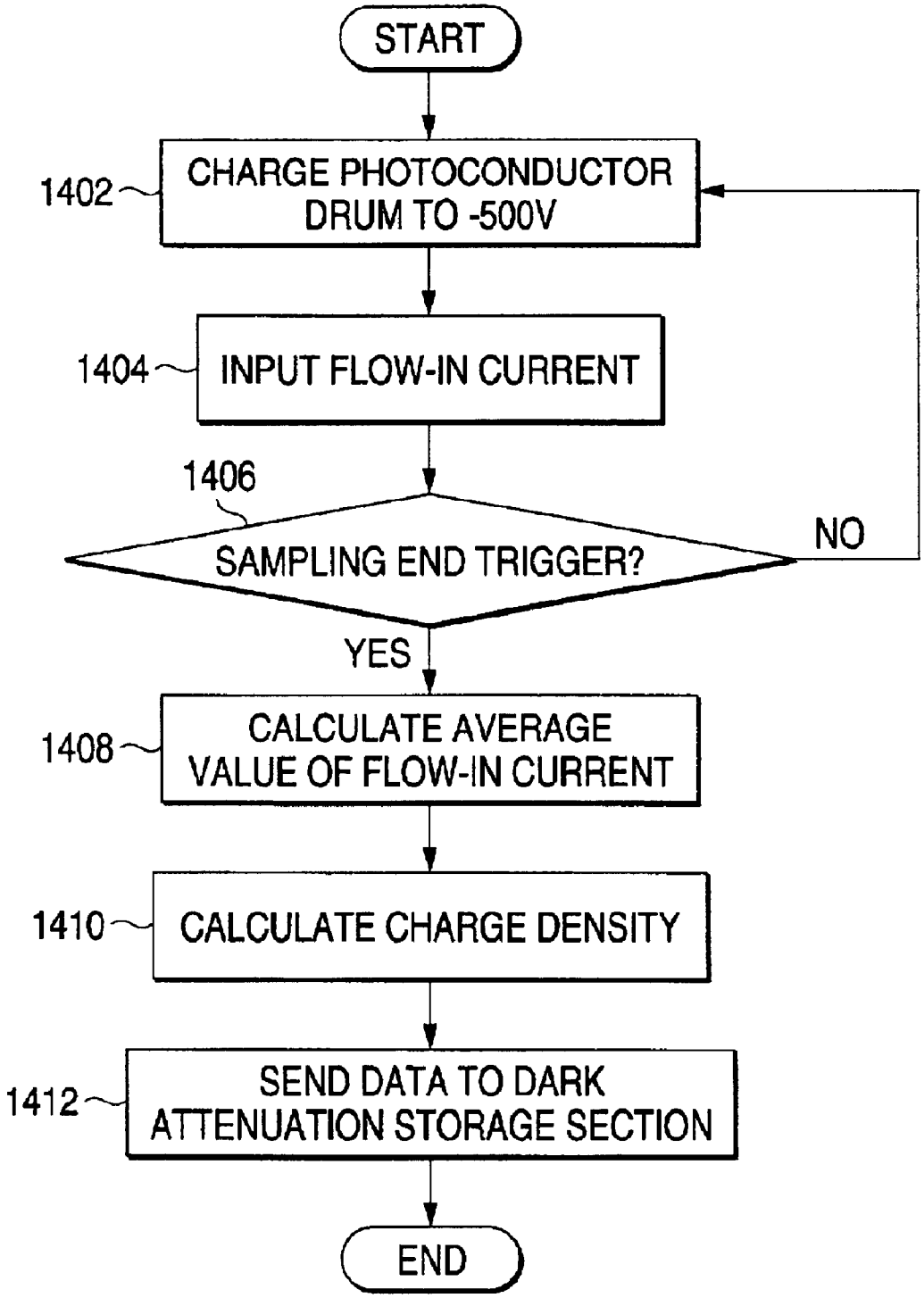
FIG. 14 is a flowchart of calculating the surface charge density of the photoconductor drum in the first embodiment of the invention.
Figure 15:
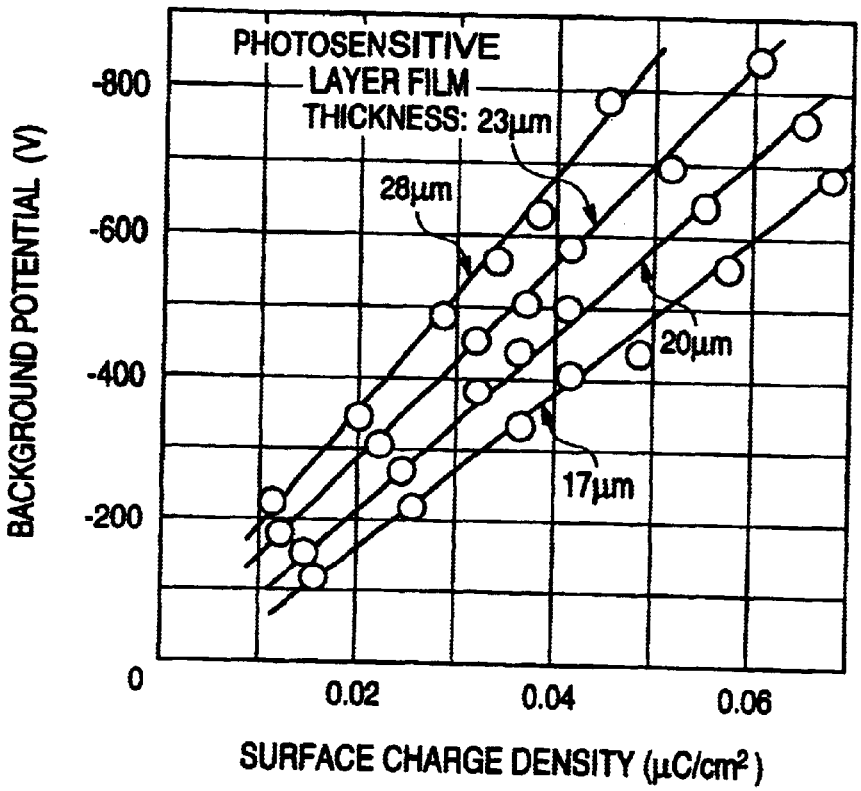
FIG. 15 is a drawing to show the relationship between the surface charge density and the background potential depending on the film thickness of the photoconductor body in the first embodiment of the invention.

Next, calculation of the surface charge density of the photoconductor drum by the light exposure control means 9 will be discussed with reference to FIGS. 14 and 15. FIG. 14 is a flowchart of processing of calculating the surface charge density of the photoconductor drum. FIG. 15 is a drawing to show the relationship between the surface charge density of the photoconductor drum and the background potential $V_0$ with the film thickness of the photosensitive layer as a parameter. If the surface charge density and the background potential are known, the film thickness of the photosensitive layer is found.

If a scorotron charger is used in the image formation apparatus of the embodiment, the film thickness of the photosensitive layer can also be determined in a similar manner. At the time, however, the charge density counter 11 counts the value of the current flowing into the photoconductor drum 1 and thus counts the current value so as to subtract the current flowing into a grid and a shield from the current input to wire.

In FIG. 14, the light exposure control means 9 first charges the photoconductor drum 1 to −500 V (S1402). The image formation apparatus of the embodiment uses a corotron-type charger as the charger 2. The difference between the current input to the wire of the charger 2 and the current flowing into the shield is counted by the charge density counter 11 (S1404 to S1408) The count is the value of the current flowing into the photoconductor drum 1 and is a value proportional to the surface charge density and can be used to calculate the surface charge density (S1410). On the other hand, the background potential at the time is detected by the potential sensor and the film thickness of the photosensitive layer is calculated from the two values. The data is recorded and retained in the dark attenuation storage section 14 (S1412).

<Second Embodiment>

Next, a second embodiment of the invention will be discussed by taking a developing device having two or more developing rolls as an example with reference to FIG. 16.

If two or more developing biases are avoided at the same time, considering the above-described carrier fly, toner is developed on a photoconductor drum based on the developing potential difference for one developing roll by distance Ad between developing nips. If the number of developing rolls becomes N, the developed toner area is developed in the range of $(N-1)\times\Delta d$ in the circumferential direction of the photoconductor drum. Thus, it is easily estimated that an enormous potential detection area will become necessary with an increase in the number of developing rolls. To avoid this disadvantage, in the second embodiment, for the developing devices having two or more developing rolls, the developing biases are avoided in order starting at the upstream developing roll toward the rotation direction of the photoconductor drum at developing bias avoiding timings t1 and t2. Accordingly, it is made possible to detect the potential in developing the same area as the recording apparatus described in the first embodiment.

Figure 16:
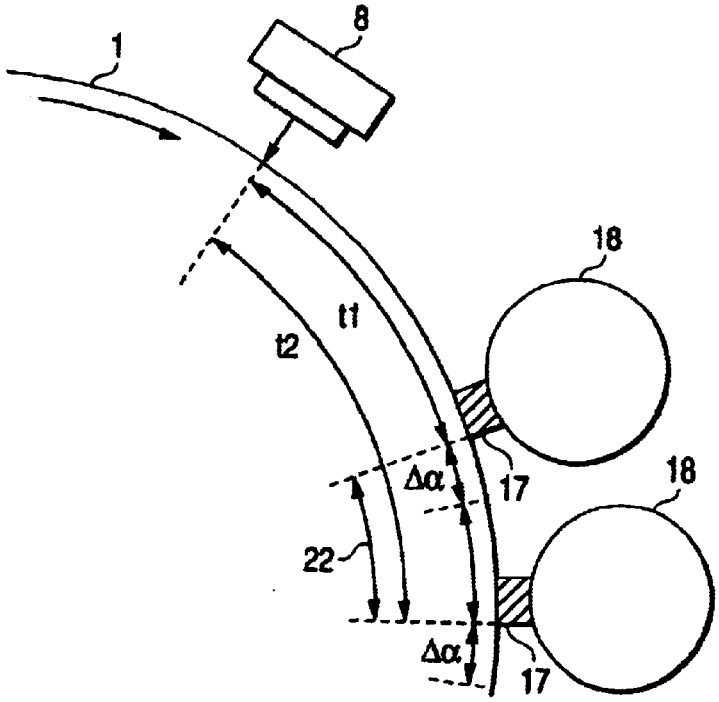
FIG. 16 is a schematic drawing to show developing bias avoidance timings of a developing device having two developing rolls in a second embodiment of the invention.

FIG. 16 shows the developing device having two developing rolls as a specific example, but a similar method is used if the developing device has three or more developing rolls. The potential level of the developing bias after avoidance and the developing bias avoidance timing are similar to those in the first embodiment. Further, computation of correction potential amount based on dark attenuation of the photoconductor drum is also similar to that in the first embodiment.

<Third Embodiment>

Next, a third embodiment of the invention will be discussed. First, varying of an electrostatic latent image on the surface of a photoconductor drum with time will be discussed. When the photoconductor drum is degraded as the print amount grows, the charge area potential (charge potential) lowers and it becomes hard to charge. Therefore, background potential $V_0$ lowers. On the other hand, the discharge area potential (discharge potential) rises and it becomes hard to discharge. Lowering the discharge performance is remarkable if an intermediate potential area with incomplete discharge with an insufficient exposure light amount given is provided.

In the embodiment, middle potential $V_{r2}$ is applied. The described potential change acts in the direction of lowering the developing electric field to lessen the developing potential difference. On the other hand, in addition to the characteristic, the thickness of the photosensitive layer of the photoconductor drum decreases due to wear as the print amount grows. The decrease in the film thickness acts in the direction of increasing the developing electric field. Decrease in the developing electric field caused by decrease in the developing potential difference applies to both the peripheral electric field and internal parallel electric field. However, the latter increase in the developing electric field caused by the decrease in the film thickness applies only to the peripheral electric field. The image for which the two mutually contradictory tendencies are a problem is a line image, dots, or the edge part of a solid area where the developing electric field is affected by the peripheral effect. Which of the two mutually contradictory tendencies is superior varies depending on the printing apparatus, the print history, etc. This means that although the developing performance changes with time and the image quality changes accordingly, the change manner varies from one printing apparatus to another or depending on the print history, etc., if the apparatus are of the same configuration.

Figure 17:
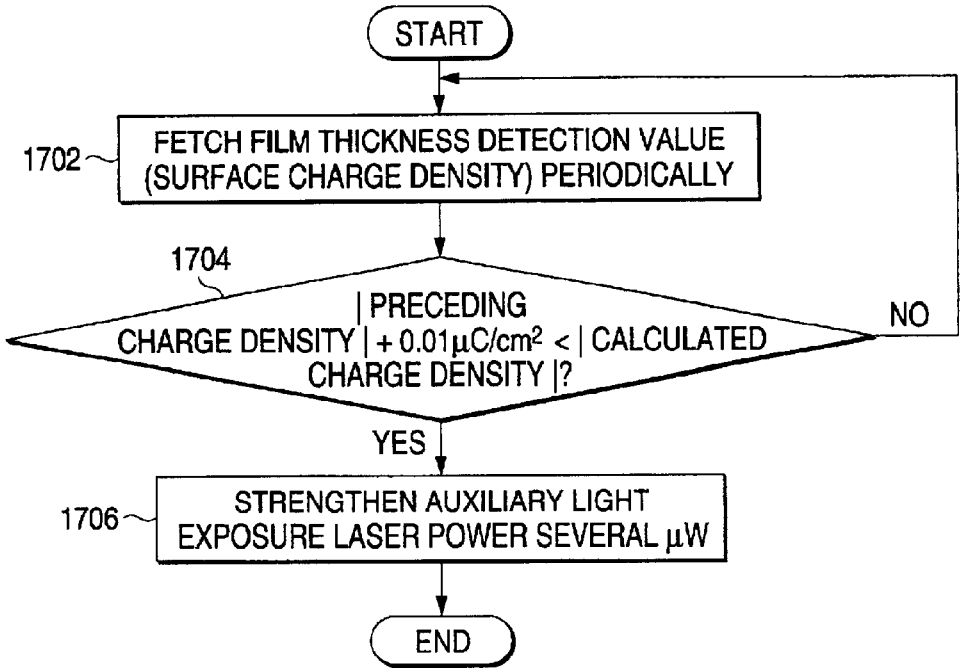
FIG. 17 is a flowchart of auxiliary light exposure control in a third embodiment of the invention.

FIG. 17 is a flowchart of auxiliary light exposure control in the third embodiment of the invention. First, film thickness detection value (=surface charge density) is fetched periodically (S1702). If the absolute value of the preceding charge density+0.01 $\mu C/cm^2$ is less than the absolute value of calculated charge density (S1704), auxiliary light exposure laser power is strengthened several $\mu W$ (S1706).

Figure 18:
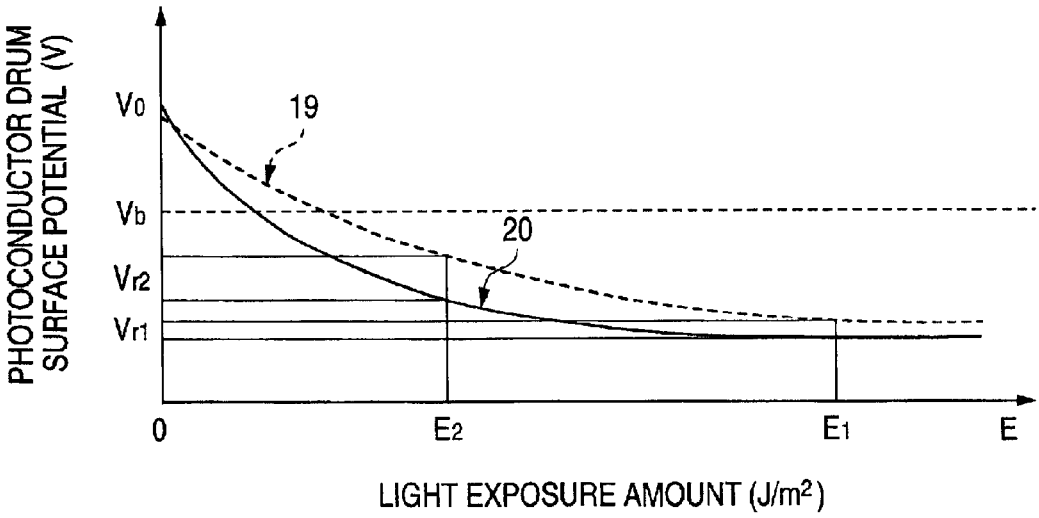
FIG. 18 is a drawing to show the light response characteristic of the initial state and degradation state of a photoconductor drum 1 in the third embodiment of the invention.

FIG. 18 shows the relationship between light exposure amount E in image formation apparatus under going auxiliary light exposure control and the surface potential of photoconductor drum 1 in the embodiment. Like FIG. 3, FIG. 18 is a drawing to show the light response characteristic of the photoconductor drum 1 and shows two states of an initial state 19 and a state 20 close to the life as degradation advances. According to the embodiment, $V_0$ lowers due to degradation, but stays within the range of small effect on the image quality. It is seen that potential ($V_{r2}$) corresponding to $E_2$ is more affected by degradation as compared with potential ($V_{r1}$) corresponding to $E_1$. Therefore, in the image formation apparatus of the embodiment, the light exposure amount $E_2$ is controlled so that the light exposure amount $E_2$ is varied for keeping the surface potential $V_{r2}$ of the photoconductor drum 1 constant.

Figure 19A:
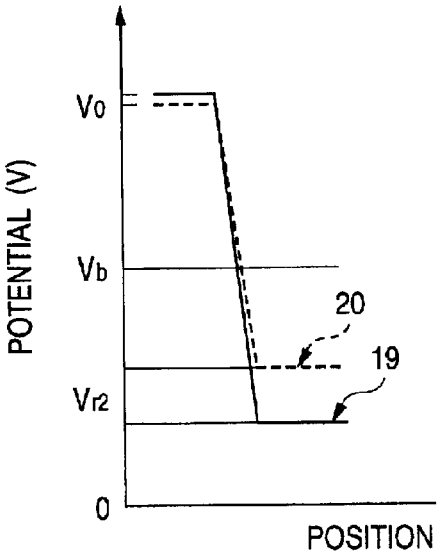
FIGS. 19A and 19B show examples of potential and electric field distributions of a latent image of the photoconductor drum 1 in the third embodiment of the invention.
Figure 19B:
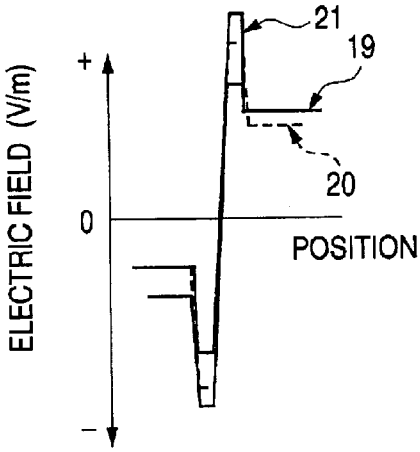

FIGS. 19A and 19B show examples of potential and electric field distributions of a latent image of the photoconductor drum 1. FIG. 19A shows the potential distribution and FIG. 19B shows the electric field distribution. As the state of the photoconductor drum 1, numeral 19 denotes the initial state of the photoconductor drum 1 with the light exposure amount $E_2$ not controlled and numeral 20 denotes the degradation state of the photoconductor drum 1 with the light exposure amount $E_2$ not controlled. As previously described with reference to FIG. 18, as the photoconductor drum 1 is degraded, $V_0$ lowers and $V_{r2}$ rises and the developing potential lowers, but as the film thickness of the photosensitive layer of the photoconductor drum 1 lowers, the developing electric field corresponding to the developing potential increases.

Numeral 21 in FIG. 19B shows the electric field distribution when $V_{r2}$ is controlled constant. It is seen that the developing electric field increases more remarkably. FIGS. 19A and 19B show the case where the developing electric field increases if $V_{r2}$ is not controlled constant; if the degradation state of the photoconductor drum 1 differs, the developing electric field may lower. In any case, if $V_{r2}$ is controlled constant, only the effect caused by decrease in the film thickness is received and thus the developing electric field increases.

The reason is that the electric field is affected by the two independent factors of the potential difference and the film thickness, as described above. Therefore, to keep the image quality stably as time goes by, it becomes necessary to control both the potential and the electric field constant. To control the potential constant, the potential at the developing point is calculated from the detection value of potential sensor 10 and the light exposure amount of light exposure unit 8 is adjusted by light exposure control means 9 based on the calculation value according to the method shown in the first embodiment. On the other hand, to control the electric field constant, first the strength of the electric field needs to be known. The strength of the electric field is determined by the photoconductor drum film thickness as described above. In the image formation apparatus of the embodiment, the film thickness detection method described in the first embodiment is used as the detection method of change in the electric field strength based on the film thickness.

Figure 20:
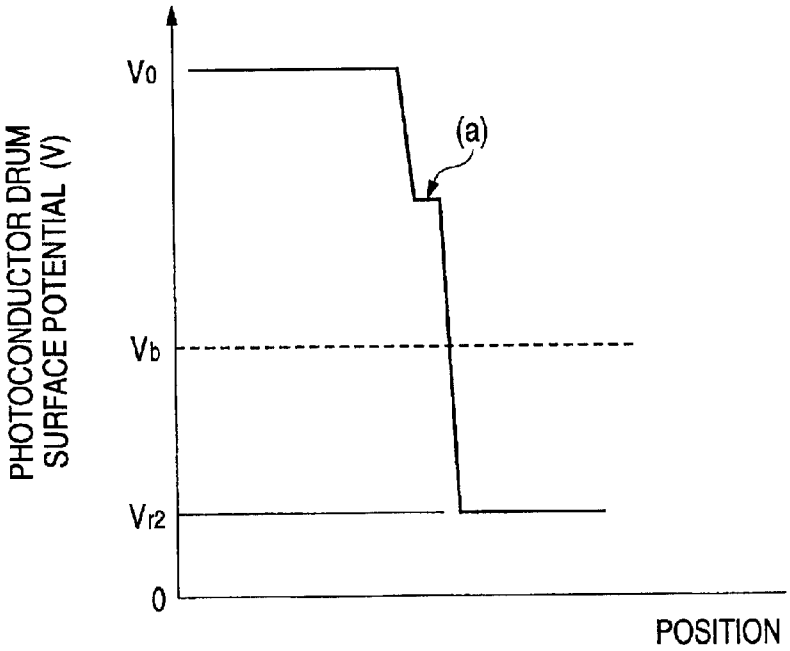
FIG. 20 is a drawing to show the potential distribution on the surface of the photoconductor drum 1 at the developing time when the peripheral electric field is controlled in the third embodiment of the invention.

FIG. 20 is a drawing to show the potential distribution on the surface of the photoconductor drum 1 at the developing time when the control of weakening the peripheral electric field described above is performed. The light exposure amount is dropped corresponding to the image surrounding positions so that the slight stepwise potential distribution indicated by a in the figure is provided in the periphery of an image. Light exposure to produce the stepwise distribution is called auxiliary light exposure. Steep change in the potential in the periphery of the image is prevented by the auxiliary light exposure and consequently the peripheral electric field is weakened. The dot density of the recording apparatus is 600 dots/inch. An image signal is input to memory before light exposure and all image peripheries are detected by a pattern matching method and the auxiliary light exposure is applied to two dots of the periphery of the image. The internal table of the light exposure control means 9 described above is prepared according to the relationship between the film thickness of the photosensitive layer detected and the auxiliary light exposure amount, and the strength of the auxiliary light exposure is determined by the film thickness of the photosensitive layer.

According to the embodiment described above, particularly the potential ($V_{r2}$) of a line image part using unstable middle potential becomes constant as time goes by, and a rise in the peripheral electric field is also suppressed, so that stable image quality can be provided as time goes by.

As described above, according to the invention, the potential sensor is placed at the position after transfer and the potential on the photoconductor drum surface is detected. When the potential is detected, the toner covering percentage of the image area on the photoconductor drum is lowered, so that flexibility of photoconductor material and print process design can be enlarged.

The potential on the photoconductor drum surface is detected and feedback control is applied, whereby the developing potential on the photoconductor drum surface is kept stable as time goes by, the film thickness of the photoconductor drum is detected by the detection means, and the electric field in the periphery of the image is controlled to be stable based on the detected information, so that a print control method can be provided for keeping the image quality stable as time goes by if degradation of the photoconductor drum or a decrease in the film thickness occurs.

What is claimed is:

1. A print control method of an electrophotograph in an image formation apparatus including at least a photoconductor, a charger, a light exposure unit, and a developing device for forming a background area and an image area on the photoconductor using the charger and the light exposure unit and detecting a potential of the image area after transfer and controlling a developing electric field, thereby printing an electrophotograph, said method comprising:

lowering the percentage of toner covering the image area on the photoconductor when the potential is detected.

2. The print control method of an electrophotograph as claimed in claim 1 wherein when the potential is detected, carrier fly suppression control is performed.

3. The print control method of an electrophotograph as claimed in claim 2 wherein a middle potential is set between a latent image potential and a developing bias in addition to potentials of the background area and the image area; and wherein the middle potential is used to control either or both of an edge part of a solid image area and a thin line.

4. The print control method of an electrophotograph as claimed in claim 3 wherein the middle potential is detected by a potential sensor.

5. The print control method of an electrophotograph as claimed in claim 1, wherein when the potential is detected, avoidance control of a developing bias applied to the developing device is performed so as to lower the toner covering percentage on the photoconductor.

6. The print control method of an electrophotograph as claimed in claim 2, wherein, when the potential is detected and the detected potential passes through a developing nip width of the developing device, avoidance control of a developing bias is performed to suppress a carrier fly.

7. The print control method of an electrophotograph as claimed in claim 1 wherein in the developing device having at least two or more developing rolls, developing biases are avoided in order starting at the upstream developing roll in a photoconductor rotation direction at developing bias avoiding timings.

8. The print control method of an electrophotograph as claimed in claim 7, wherein the developing device having at least two or more developing rolls, when the potential is detected, avoidance control of a developing bias applied to the developing device is performed so as to lower the toner covering percentage on the photoconductor, and wherein when the potential is detected and the detected potential passes through a developing nip width of the developing device, avoidance control of a developing bias is performed to suppress a carrier fly.

9. A print control method in an image formation apparatus of an electrophotograph comprising at least a photoconductor, a charger, a light exposure unit, and a developing device for forming a background area and an image area on the photoconductor using the charger and the light exposure unit and detecting a potential of the image area after transfer, said method comprising the steps of:

setting a middle potential between a latent image potential and a developing bias; and detecting a film thickness of the photoconductor to perform feedback control of the middle potential so that a developing electric field becomes constant based on the detected film thickness.

10. The print control method as claimed in claim 9 wherein a humidity sensor is placed in the image formation apparatus.

11. The print control method as claimed in claim 9 wherein a charge density of the photoconductor is counted to detect the film thickness of the photoconductor.

12. The print control method as claimed in claim 11, wherein a peripheral electric field of the image area is controlled based on a detection value of the film thickness of the photoconductor.

13. The print control method as claimed in claim 11, wherein the image formation apparatus includes a dark attenuation storage section storing the potential lowering amount which is caused by dark attenuation of the photoconductor previously detected by the light exposure unit and corresponding to a detection value of the film thickness of the photoconductor and a detection value of a humidity sensor.

14. The print control method as claimed in claim 13 wherein the potential detected after transfer is corrected according to the potential lowering amount based on the detection value of the humidity sensor and the detection value of the film thickness.

15. An image formation apparatus of an electrophotograph comprising:

a photoconductor;

a charger;

a light exposure unit;

a developing device for forming a background area and an image area on the photoconductor using the charger and the light exposure unit which detects a potential of the image area after transfer and controls a developing electric field; and a toner covering percentage lowering unit adapted to lower the toner covering percentage of the image area on the photoconductor when the potential is detected.

16. The image formation apparatus of an electrophotograph as claimed in claim 15 further comprising a carrier fly suppression unit adapted to suppress carrier fly.

17. An image formation apparatus of an electrophotograph comprising:

a photoconductor;

a charger;

a light exposure unit;

a developing device for forming a background area and an image area on the photoconductor using the charger and the light exposure unit and detecting a potential of the image area after transfer;

a middle potential setting unit adapted to set a middle potential between a latent image potential and a developing bias; and a middle potential controller adapted to detect a film thickness of the photoconductor and performing feedback control of the middle potential so that a developing electric field becomes constant based on the detected film thickness.

* * * * *